US005355199A

United States Patent [19]

Bray

[11] Patent Number: 5,355,199

[45] Date of Patent: Oct. 11, 1994

[54] DEVELOPMENT UNIT FOR AN ELECTROPHOTOGRAPHIC PRINTER HAVING A TORQUE-TRIGGERED OUTLET PORT

[75] Inventor: Daniel M. Bray, Rochester, N.Y.

[73] Assignee: Xerox Corporation, Stamford, Conn.

[21] Appl. No.: 125,889

[22] Filed: Sep. 24, 1993

[51] Int. Cl.[5] ..... G03G 15/06

[52] U.S. Cl. ..... 355/245; 118/652; 118/653; 355/246

[58] Field of Search ..... 355/205, 206, 207, 208, 355/245, 246, 251, 259, 261, 296, 298; 118/651, 661, 653, 656–658, 652; 340/606, 608, 610; 73/1 C

[56] References Cited

U.S. PATENT DOCUMENTS

| | | | |
|---|---|---|---|
| 3,979,022 | 9/1976 | Whited | 118/653 |
| 4,101,211 | 7/1978 | Kayson | 355/215 |
| 4,439,034 | 3/1984 | Daniels | 118/658 |
| 4,452,174 | 6/1984 | Fedder | 118/689 |
| 4,614,165 | 9/1986 | Folkins et al. | 118/657 |
| 4,668,074 | 5/1987 | Hirozane | 355/245 X |
| 4,891,673 | 1/1990 | Buell | 355/245 |
| 4,932,355 | 6/1990 | Neufeld | 118/652 |
| 4,982,230 | 1/1991 | Ogara et al. | 355/206 |
| 5,020,471 | 6/1991 | Yoshikai | 118/653 |
| 5,025,289 | 6/1991 | Guslits et al. | 355/253 |
| 5,200,787 | 4/1993 | Nishiguchi | 355/298 |
| 5,235,391 | 8/1993 | Aimoto | 355/245 X |
| 5,250,749 | 10/1993 | Aimoto | 118/653 |

FOREIGN PATENT DOCUMENTS

| | | |
|---|---|---|
| 0098772 | 7/1980 | Japan . |
| 0253278 | 10/1990 | Japan . |

*Primary Examiner*—Robert B. Beatty
*Attorney, Agent, or Firm*—R. Hutter

[57] ABSTRACT

A developer unit for an electrophotographic printer includes a housing defining a chamber for retaining developer material. An auger is rotatable within the chamber for the conveying of developer material within the chamber. The auger and a second rotatable member are adapted to receive rotational drive from a single source of rotational motion. A clutch is responsive to a torque above a predetermined level associated with the auger. A selectably openable outlet port is adapted to permit escape of developer material from the chamber. A linkage is operatively disposed between the clutch and the openable outlet port. A torque above a predetermined level associated with the auger causes the clutch to move the linkage, causing the mechanical linkage to open the outlet port.

14 Claims, 4 Drawing Sheets

DEVELOPMENT UNIT FOR AN ELECTROPHOTOGRAPHIC PRINTER HAVING A TORQUE-TRIGGERED OUTLET PORT

This invention relates generally to an electrophotographic printing machine, and more particularly concerns an apparatus for developing an electrostatic latent image recorded on a photoconductive member used in the electrophotographic printing machine.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. This forms a powder image on the photoconductive member which is subsequently transferred to a copy sheet and permanently affixed thereto in image configuration.

Typically, the developer material comprises toner particles adhering triboelectrically to magnetic carrier granules. This two component mixture is brought into contact with the photoconductive surface. The toner particles are attracted from the carrier granules to the latent image. It is clear that the developer material is a critical component of the printing machine. As the developer material ages and approaches the end of its useful life, copy quality deteriorates. It has been found that by adding additional carrier granules, the life of the developer material can be significantly increased. However, as additional carrier granules are added to the chamber storing the developer material, developer material must be removed therefrom to maintain the developer material therein at the desired quantity. In a developer unit wherein carrier granules and toner particles are added to the chamber of the developer housing, provision must be made for regulating the discharge of developer material therefrom to maintain the desired quantity of developer material. Thus, it is necessary to use a control valve to regulate the discharge of developer material from the chamber of the developer housing.

U.S. Pat. No. 4,101,211 discloses a development unit having a sump wherein an auger moves developer between the sump and the development unit. A magnetic curtain seal is disposed adjacent the auger to attract sufficient developer to block the auger passageway and thereby prevent toner dust from escaping from the sump.

U.S. Pat. No. 4,452,174 discloses a development unit having a toner concentration sensor. A portion of the developer is mete red off the magnetic brush and caused to pass through a chute where it is temporarily retained by an electromagnet- The developer mix within the chute is then inductively analyzed to determine the toner-carrier ratio therein.

U.S. Pat. No. 4,614,165 discloses a development apparatus wherein additional carrier granules are continually added to developer material in the chamber of the developer housing. An exit port is provided to remove the excess developer material so as to maintain the developer material at a predetermined quantity.

U.S. Pat. No. 4,891,673 describes a developer unit in which carrier granules are added to the developer material in conjunction with toner particles. When the level of developer material in the developer housing is at the exit port, developer material is discharged from the chamber. A permanent magnet is positioned around the exit port to generate a magnetic flux field to form a carrier bead curtain which prevents the passage of toner particles while permitting developer material and carrier granules to exit.

U.S. Pat. No. 4,982,230 discloses a cleaning (as opposed to developing) unit for removing excess toner from a photoreceptor surface. Beneath a blade which scrapes the excess toner from the surface is an auger which conveys the removed toner particles across the unit to a toner collecting unit at the end of the auger. The auger is directly driven by its own motor. The patent discloses means for detecting an anomaly either in the rotational speed of the motor, or means for detecting an electrical feedback on the motor caused by a mechanical resistance on the auger, such as would be caused by a compression of excess toner by the auger.

According to the present invention, there is provided a developer unit for an electrophotographic printer, comprising a housing defining a chamber for retaining developer material therein. An auger is rotatable within the chamber for the conveying of developer material within the chamber. The auger and a second rotatable member are adapted to receive rotational drive from a source of rotational motion in the printer. A clutch is responsive to a torque outside a predetermined range associated with the auger. A selectably openable port is defined in the housing to permit passage of developer material to or from the chamber. A linkage is operatively disposed between the clutch and the openable outlet port. A torque outside a predetermined range associated with the auger causes the clutch to move the linkage, causing the mechanical linkage to open the port.

Figure 4:
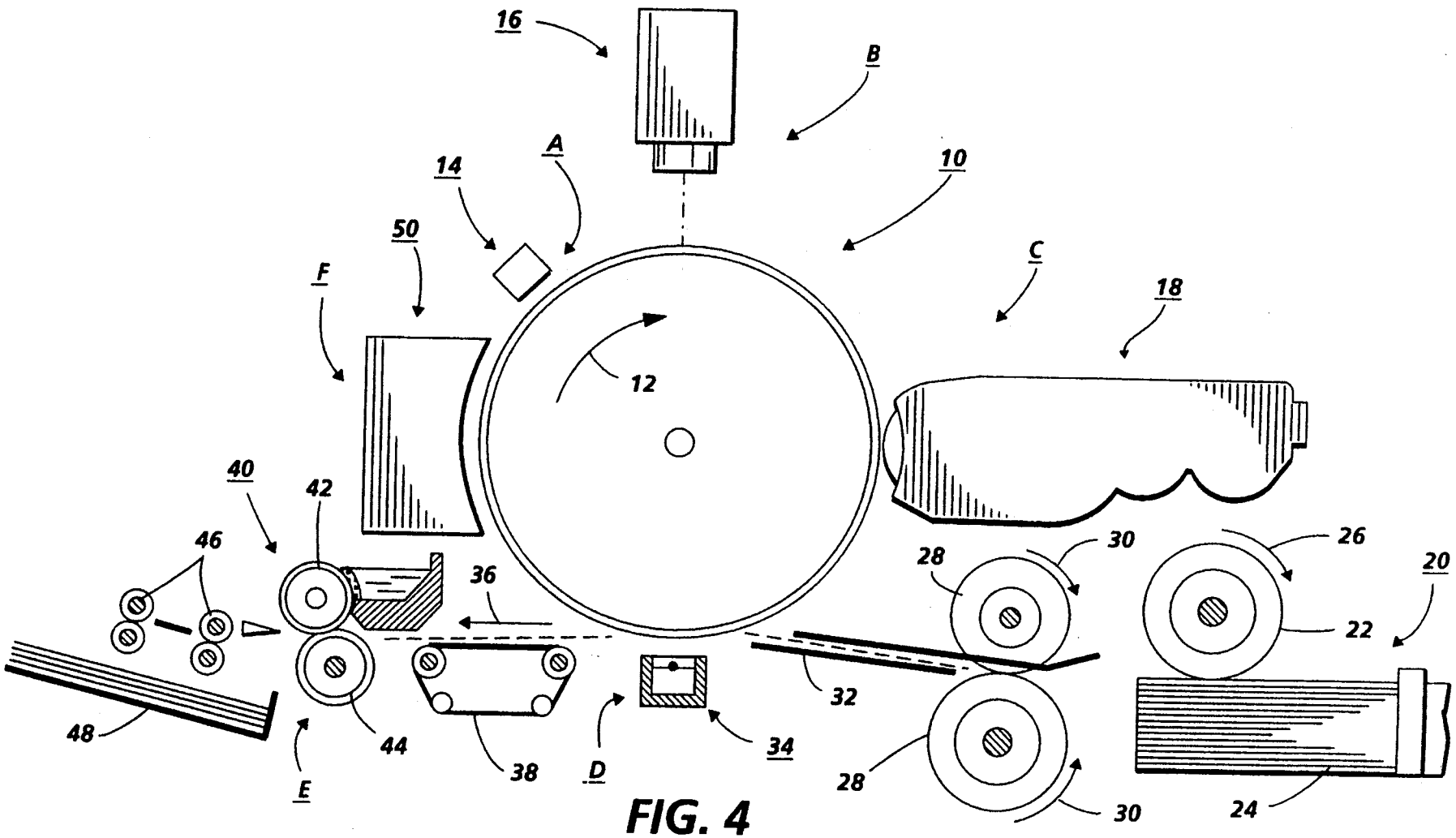
FIG. 4 is a schematic elevational view showing an illustrative electrophotographic printing machine incorporating the features of the present invention therein.

FIG. 4 schematically depicts the various components of an illustrative electrophotographic printing machine having the developer unit of the present invention therein. It will become evident from the following discussion that this developer unit is equally well suited for use in a wide variety of printing machines and is not necessarily limited in its application to the particular printing machine described herein.

As shown in FIG. 4, the illustrative electrophotographic printing machine employs a photoreceptor 10, having a photoconductive surface adhering to a conductive substrate. Photoreceptor 10 moves in the direction of arrow 12 to advance successive portions of the photoconductive surface sequentially through the various processing stations disposed about the path of movement thereof.

Initially, a portion of the photoconductive surface passes through charging station A. At charging station A, a corona generating device, indicated generally by the reference numeral 14, charges the photoconductive surface to a relatively high, substantially uniform potential. Next, the charged portion of the photoconductive surface is advanced through imaging station B. Imaging station B includes an exposure system, indicated generally by the reference numeral 16. Exposure system 16 includes lamps which illuminate an original document positioned face down upon a transparent platen. The light rays reflected from the original document are transmitted through a lens to form a light image thereof. The light image is focused onto the charged portion of the photoconductive surface to selectively dissipate the charge thereon. This records an electrostatic latent image on the photoconductive surface which corresponds to the information in the original document. In lieu of the foregoing optical system, a modulated beam of energy, i.e. a laser beam, or other suitable device, such as light emitting diodes, may be used to irradiate the charged portion of the photoconductive surface so as to record selected information thereon. Information from a computer may be employed to modulate the laser beam.

After the electrostatic latent image is recorded on the photoconductive surface, photoreceptor 10 advances the electrostatic latent image to development station C. At development station C, a magnetic brush developer unit, indicated generally by the reference numeral 18, transports a developer material closely adjacent to, or into contact with, the electrostatic latent image. The developer material typically comprises magnetic carrier granules having toner particles adhering triboelectrically thereto. Toner particles are attracted from the carrier granules to the latent image forming a toner powder image. In the development system, toner particles and a small amount of carrier granules are continually added to the developer material so that the life of the developer material is at least equal to the useful life of the electrophotographic printing machine. Further details of developer unit 18 will be described hereinafter with reference to FIG. 1.

Photoreceptor 10 then advances the toner powder image to transfer station D. At transfer station D, a sheet of support material is moved into contact with the toner powder image. The sheet of support material is advanced to transfer station D by a sheet feeding apparatus, indicated generally by the reference numeral 20. Preferably, sheet feeding apparatus 20 includes a feed roll 22 contacting the uppermost sheet of a stack of sheets 24. Feed roll 22 rotates in the direction of arrow 26 to advance the uppermost sheet into a nip defined by forwarding rollers 28. Forwarding rollers 28 rotate in the direction of arrow 30 to advance the sheet into chute 32. Chute 32 directs the advancing sheet into contact with the photoconductive surface in a timed sequence so that the toner powder image developed thereon contacts the advancing sheet at transfer station D.

Transfer station D includes a corona generating device 34 which sprays ions onto the backside of the sheet. This attracts the toner powder image from the photoconductive surface to the sheet. After transfer, the sheet continues to move in the direction of arrow 36 on conveyor 38 to advance to fusing station E.

Fusing station E includes a fuser assembly, indicated generally by the reference numeral 40, which permanently affixes the transferred toner powder image to the sheet. Preferably, fuser assembly 40 includes a heated fuser roller 42 and a back-up roller 44. The sheet passes between fuser roller 42 and back-up roller 44 with the powder image contacting fuser roller 42. In this manner, the toner powder image is permanently affixed to the sheet. After fusing, forwarding rollers 46 advance the sheet to catch tray 48 for subsequent removal from the printing machine by the operator.

After the powder image is transferred from the photoconductive surface to the copy sheet, photoreceptor 10 rotates the photoconductive surface to cleaning station F. At cleaning station F, a cleaning system, indicated generally by the reference numeral 50, removes the residual particles adhering to the photoconductive surface. In this way, the residual toner particles are removed from the photoconductive surface.

Figure 1:
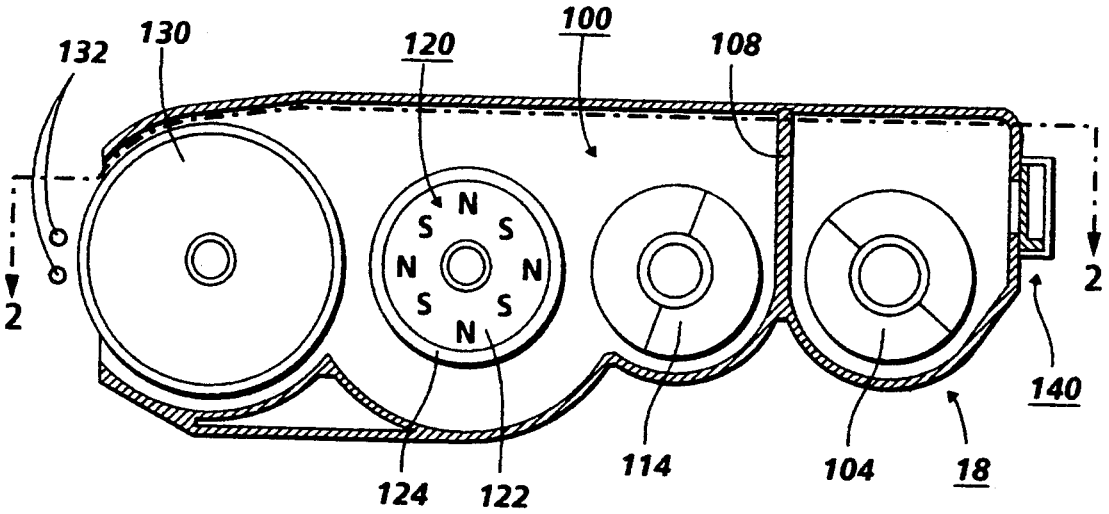
FIGS. 1 is an elevational and plan views of a developer unit according to the present invention.
Figure 2:
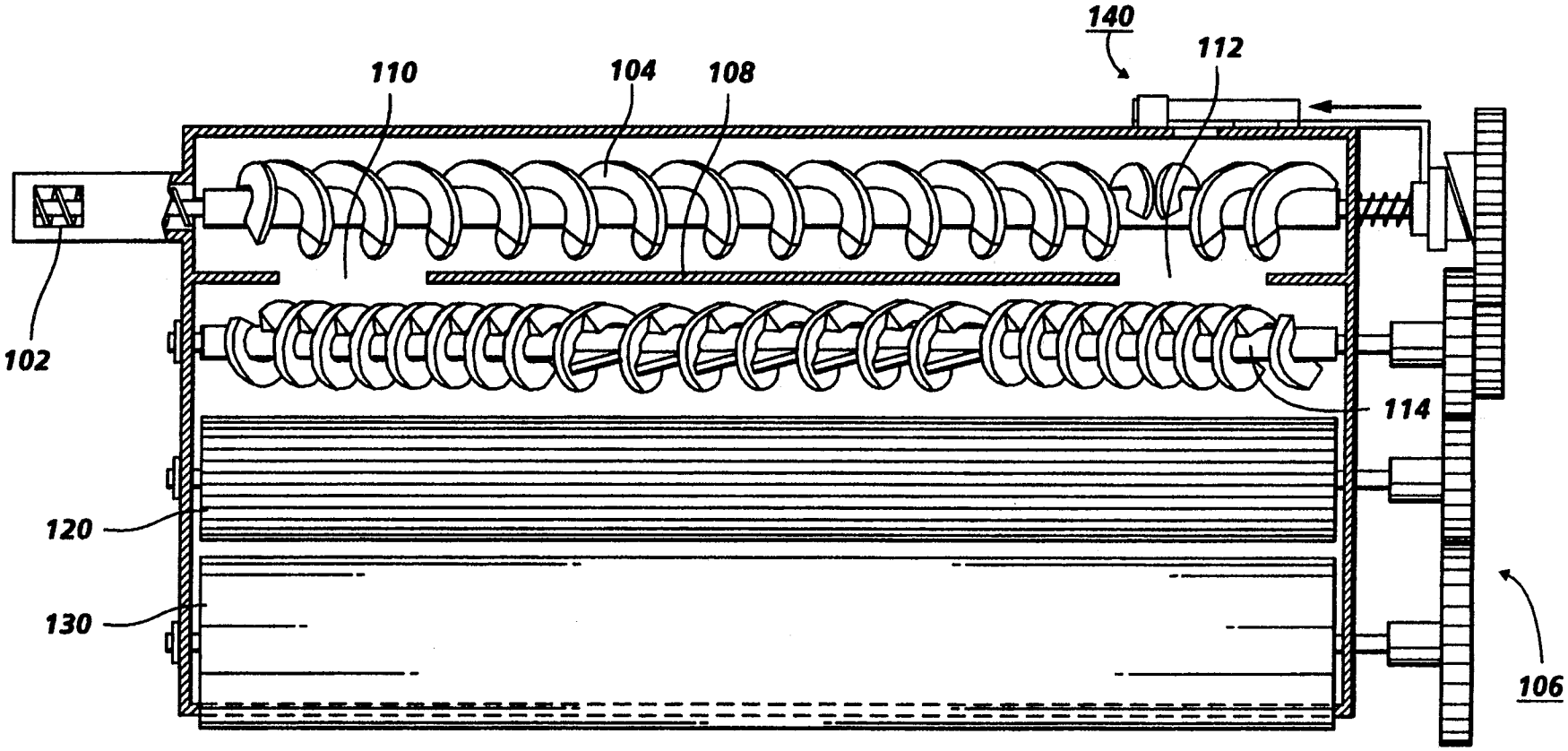
FIG. 2 is a plan view of a developer unit according to the present invention.

FIGS. 1 and 2 are, respectively, elevational and planned sectional views of a developer unit incorporating the torque-trigger device of the present invention. The specific embodiment of the developer unit shown in FIGS. 1 and 2 is of the "hybrid scavengeless" type, which is generally characterized by the presence of electrode wires between a donor roll in the developer unit and a latent image to be developed. For general discussions of scavengeless development, attention is directed to U.S. Pat. No. 4,868,600, U.S. Pat. No. 4,984,019, or U.S. Pat. No. 5,010,367, each incorporated by reference herein.

Turning to the general function of the developer unit generally marked 18 in FIGS. 1 and 2, developer material, which is in the illustrated embodiment intended to comprise toner particles mixed to a certain proportion with a quantity of magnetic carrier particles, is admitted from an inverted supply bottle (not shown) into an entry port shown in FIG. 2 as 102. Developer entering into this port 102 is collected in the vanes of an auger 104 which extends the widths of the developer housing, as shown. Auger 104 is preferably in the form of a true screw (although pseudo-screw configurations are possible), and is adapted to cause a flow of developer across the chamber of the developer unit as shown in FIG. 2. As can be seen, the entire developer unit 18 is enclosed in a single housing forming a chamber 100, with the auger 104 further enclosed within a segregated housing by a barrier 108. However, as can be seen in FIG. 2, the barrier 108 includes at the ends thereof openings 110 and 112 accessing the rest of the chamber 100. The screw threads of auger 104 change direction toward the opening I 12, such that when a quantity of developer is moved to the right side of developer unit 18 in the view of FIG. 2, it will eventually be pushed through the opening 112 to be collected by the vanes of a second auger 114.

Augers 104 and 114 are caused to rotate in a cooperating manner by a mechanical linkage generally indicated as 106, such as gears, belts, or a combination thereof, so as to create a reasonably constant flow of developer material along auger 104, through opening 112, along auger 114, and through opening 110 back to auger 104 in a generally clockwise cycle in the view of FIG. 2. In this way, a reasonably constant flow of developer material is created along the width of the developer unit 18.

Parallel and adjacent to the auger 114 is a rotatable magnetic roll 120. The magnetic roll 120 includes an assembly of magnets generally shown as 122 mounted stationarily inside a rotatable sleeve 124. Rotatable sleeve 124 typically has defined therein a series of grooves to insure the proper gripping of magnetic material thereon. The developer comprises toner particles and magnetic carrier particles. As is well known, this mixture creates a magnetic brush, much like that created by iron filings, in the presence of a magnetic field such as provided by magnetic assembly 102. The developer on the surface of the sleeve 124 of magnetic roll 120 thus forms a brush by which the magnetized carrier particles form filaments of the brush and the toner particles adhere to the carrier particles triboelectrically. This magnetic brush of developer material is used to load the donor roll 130.

In the illustrated embodiment of the present invention, donor roll 130 is electrically biased (by means not shown) to maintain a relatively stable layer of toner particles from the magnetic brush on magnetic roll 120 on the surface thereof. This layer of toner particles is then, by the rotation of donor roll 130, introduced to the electrostatic latent image on the photoreceptor. In the illustrated embodiment, the toner particles on the donor roll 130 are excited off the surface of the donor roll 130 by means of an AC field introduced by a plurality of electrode wires 132 which are disposed between the surface of the donor roll 130 and the latent image. The AC fields from the electrode wires 132 create the desired powder cloud of free toner particles which are attracted in imagewise fashion to the electrostatic latent image on the photoreceptor.

In a preferred practical design of a developer unit for use with the present invention, all of the main rotating parts within the unit, such as augers 104 and 114, magnetic roll 120, and donor roll 130, are caused to rotate in a cooperating manner by a mechanical system, shown generally as 106, which may include belts and/or gears. (As used in the claims herein, one such rotating part is referred to as "a second member, rotatable within the chamber".) All of the main rotating parts can in this way be driven by a single source of rotational motion (not shown). It is to be understood that a system such as 106 will be designed to provide an advantageous combination of rotational speeds and torques for all the rotating parts for optimal performance of the developer unit. Certain rotational parameters, such as the absolute speed of the donor roll 130 and the speed of the magnetic roll 120 relative to the donor roll 130, are extremely crucial to print quality. However, when additional rotating members are within the same mechanical system, such as augers 104 and 114, an increase in torque or a slowdown in speed of one auger can become a "drag" to the whole system, with deleterious effects on print quality.

The torque-trigger device of the present invention is intended to regulate the quantity and flow of developer material through this developer unit, particularly as it relates to the behavior of the augers 104 and 114, while minimizing the system-wide effects of a slowdown in speed of one auger. In particular, if, for whatever reason, a concentration of developer material is "backed-up" along one of the augers, a clogging and compression of the developer material within the developer housing will result. This compression may have one or another deleterious effect on the performance of the developer unit. A clogging of developer material may cause the augers not to turn properly; or it may cause the ratio of toner to carrier material to vary; or the developer unit may be otherwise damaged.

In order to prevent such clogging and compression which may be caused by an overflow of developer material within the developer housing, there is provided an overflow gate from the interior of the chamber 100 which is activated (i.e., opened) in response to the detection of higher than normal torques on at least one of the augers. If too much developer material is caught within the developer housing, the compression of the extra developer material will cause one of the augers to require more than a predetermined torque to turn at the desired speed. This excess torque can thus be used to detect the condition of compression of developer material within the developer housing. The compression is relieved by allowing a quantity of the developer material to escape so that the augers may once again rotate at a normal speed and torque. The outlet port by which excess developer material is allowed to escape from the developer housing is shown in FIGS. 1 and 2 as 140.

This outlet port 140 is preferably placed adjacent to the auger 104, and more preferably toward the end of auger 104 by opening 112, although as a matter of design choice, this outlet port 140 could be placed anywhere within the developer housing. When an auger within the developer unit 18 is detected to be rotating in an abnormal manner, this condition will, in response, open the outlet port 140 to allow the excess of developer material to escape. Typically, this abnormality of rotation will be in the form of a higher torque on one auger. A relatively simple mechanical device can be used to detect an abnormal torque on one of the augers, and the outlet port 140 may be opened through a direct mechanical linkage to the auger 104.

Figure 3:
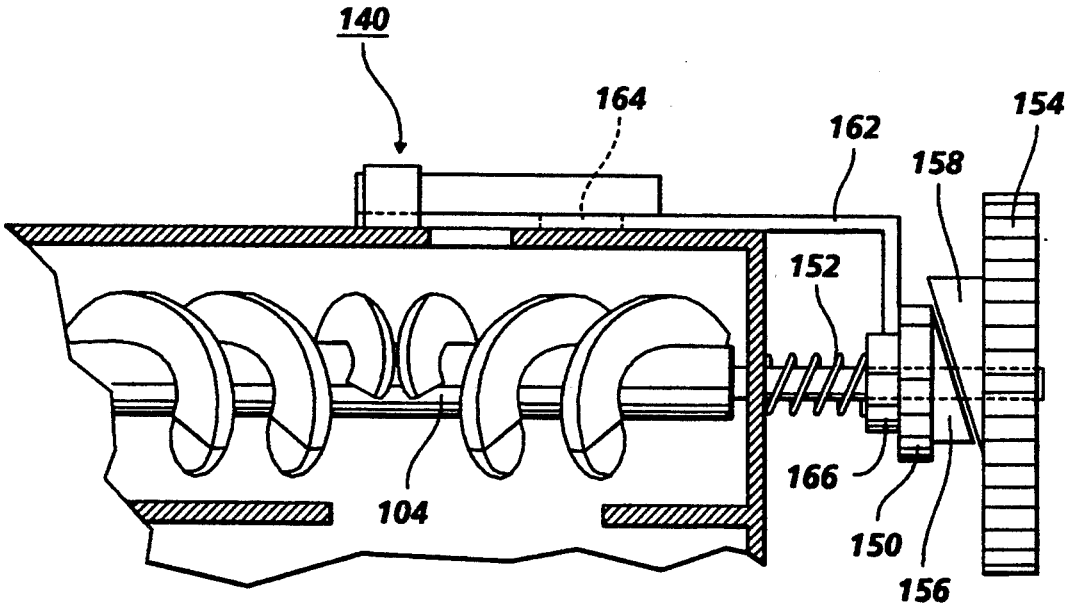
FIG. 3 is a detailed plan view of the clutch and linkage mechanism of the preferred embodiment of the present invention.

FIG. 3 is a detailed view of one possible embodiment of a clutch arrangement and mechanical linkage which may be used to translate an excess of torque on auger 104 to a mechanism for opening the outlet port 140. The illustrated device includes a thrust plate 150 which is urged by a coil spring 152 into contact with a surface of a wheel 154 which is rigidly attached longitudinally to the shaft of auger 104, but is free to rotate with respect to the auger 104. This wheel 154 is preferably the same gear or pulley by which rotational drive is originally imparted to the auger 104. The thrust plate 150 is intended to be allowed to "float" longitudinally relative to the shaft of the auger 104 but is rigidly attached to the auger 104 in the rotational axis, so as to rotate with the wheel 154. Thrust plate 150 includes thereon an inclined plane 156, which cooperates with a similar inclined plane 158 which forms part of wheel 154. When the torque between wheel 154 and thrust plate 150 exceeds a predetermined amount which is related to the spring constant of spring 152, wheel 154 and thrust plate 150 will rotate relative to each other. Ordinarily, wheel 154 rotates with the thrust plate 150 which is pressing against it by the force of coil spring I 52. When the wheel 154 and the thrust plate 150 rotate relative to each other instead of with each other, the inclined planes 156 and I 58 cause the wheel 154 and the thrust plate 150 to push away from each other, or more specifically, cause thrust plate 150 to be pushed toward the body of the developer unit 18.

Thrust plate 150 has attached thereto a linkage 162, which interacts with the opening of the outlet port 140. The linkage 162 has defined therein an opening 164 which aligns with the main opening of outlet port 140. When the thrust plate 150 is pressed toward the body of the developer unit 18 by the relative motion of wheel 154, the opening 164 in linkage 162 will align with the opening in outlet port 140 and thereby create an opening through which the excess developer material may escape. At the other end of linkage 162 is a ring 166 which is associated with thrust plate 150 in such a way that thrust plate 150 may freely rotate thereagainst, but which will move longitudinally with thrust plate 150 as part of the clutch operation.

Although in the above-described embodiment of the present invention, the general purpose of the system is to permit the escape of excess developer material in response to a higher-than-normal torque associated with one auger, it may be contemplated within the scope of the present invention to provide a system whereby another kind of anomaly of the rotation of the auger may signal the need for more developer material to be introduced into the developer unit. For example, a system could be provided by which the torque on the auger is less than a predetermined amount, and, in compensation for this, an inlet port may be opened to permit further developer material from an outside source to be introduced into the unit. Alternately, a detection of less-than-normal torque may be used to signal to the user of the apparatus that a further refill of developer material for that particular developer unit is required.

Comparing the system of the present invention to U.S. Pat. No. 4,982,230, a significant practical advantage of the present invention may be seen. Although the '230 patent discloses a general principle of detecting an anomaly in the torque or rotational speed of an auger associated with an overflow of developer material being conveyed by the auger, the use of this principle is limited in the '230 patent to a cleaning, as opposed to developing, device. It is also significant that the auger in the '230 patent requires its own dedicated motor, and an anomaly of the rotation of the auger is detected by detecting either a slowdown in the rotational speed of the motor, or electrical feedback on the motor. In contrast, the present invention uses a separate mechanical clutch to detect and make use of an excess of torque on the auger. This fact is significant if the general principle of operation is used in a developer unit, as opposed to a cleaning unit with its own dedicated motor. As shown in the preferred embodiment above, the developer unit includes not only the auger 104, but a second auger, a magnetic brush roll, and a donor roll. An efficient and elegant design is possible if all of these rotating members can be driven by a single source of rotational motion; however, an excess of torque, which may be related to a slowdown in rotational speed, will affect not only the auger in question but, because in a developer unit all of the rotational members are linked by gears and/or pulleys, also the very delicate performance of the unit as a whole. A significant slowdown in the donor roll rotational speed, for example, will have a noticeable effect on print quality as the "dwell time" of toner particles adjacent to the photoreceptor surface is varied. For this reason a slowdown in rotational speed of one auger as a result of an excess of torque thereon, may conceivably serve as a "drag" on the entire system, which is why a scheme such as in the '230 patent is difficult to apply to a developer unit, as opposed to a cleaning unit wherein the absolute rotational speed of the auger is less crucial.

However, with the clutch of the present invention, the torque/rotational speed effects of the auger can be largely insulated from the performance of the entire developer unit, while still allowing all of the parts in the unit to be driven by one source. The mechanical clutch of the present invention is not only relatively inexpensive compared to providing a separate motor for the auger and the rest of the developer unit, but also substantially minimizes the effect of toner compression from the rest of the developer unit. The mechanical clutch of the present invention can react fairly quickly to an excess of torque on the auger, while using relatively inexpensive mechanical components. The mechanical clutch of the present invention thus facilitates the desirable design of having all of the rotational members in a development unit (which may be one of a plurality of development units) operate from the rotational drive of a single source of rotational motion. For these reasons, the system of the present invention is substantially different from, and in many ways practically superior to, the system of the '230 patent.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A developer unit for an electrophotographic printer having a source of rotational motion therein, comprising:

a housing, defining a chamber for retaining developer material therein;

an auger, rotatable within the chamber for the conveying of developer material within the chamber;

a second member, rotatable within the chamber, the auger and the second member being adapted to receive rotational drive from the source of rotational motion;

a clutch responsive to a torque outside a predetermined range associated with the auger;

a selectably openable port defined in the housing, adapted to permit passage of developer material therethrough; and a linkage operatively disposed between the clutch and the openable outlet port, whereby a torque outside a predetermined range associated with the auger actuates the clutch to move the linkage to open the outlet port.

2. A unit as in claim 1, wherein the port is adapted to permit the escape of developer material from the housing, and the clutch is responsive to a torque above a predetermined range associated with the auger.

3. A unit as in claim 1, wherein the clutch comprises:

a thrust plate, associated with the linkage;

a surface rigidly associated with the auger;

means for urging tile thrust plate with a predetermined force against the surface; and means, defining opposing inclined planes between the thrust plate and the surface, whereby relative motion of the thrust plate and the surface causes the thrust plate and the surface to move away from each other.

4. A unit as in claim 1, wherein the second member includes a second auger, adapted to convey toner in a substantially opposite direction as the first-mentioned auger.

5. A unit as in claim 1, wherein the second member includes a roll adapted to convey at least a portion of the developer material.

6. A unit as in claim 1, wherein the second member includes a donor roll adapted to convey at least a portion of the developer material to an electrostatic latent image, and further comprising a magnetic roll for transporting at least a portion of the developer material to the donor roll, the magnetic roll adapted to receive rotational drive from the source of rotational motion.

7. A unit as in claim 6, further comprising a second auger, adapted to receive rotational drive from the source of rotational motion, and to convey toner in a substantially opposite direction as the first-mentioned auger.

8. An electrophotgraphic printing apparatus, comprising:

a photoconductive surface;

a source of rotational motion; and a developer unit, including a housing, defining a chamber for retaining developer material therein;

an auger, rotatable within the chamber for the conveying of developer material within the chamber;

a second member, rotatable within the chamber, the auger and the second member being adapted to receive rotational drive from the source of rotational motion;

a clutch responsive to a torque above a predetermined level associated with the auger;

a selectably openable outlet port adapted to permit escape of developer material from the chamber; and a linkage operatively disposed between the clutch and the openable outlet port, whereby a torque above a predetermined level associated with the auger actuates the clutch to move the linkage to open the outlet port.

9. An apparatus as in claim 8, wherein the port is adapted to permit the escape of developer material from the housing, and the clutch is responsive to a torque above a predetermined range associated with the auger.

10. An apparatus as in claim 8, wherein the clutch in the developer unit comprises:

a thrust plate, associated with the linkage;

a surface rigidly associated with the auger;

means for urging the thrust plate with a predetermined force against the surface; and means, defining opposing inclined planes between the thrust plate and the surface, whereby relative motion of the thrust plate and the surface causes the thrust plate and the surface to move away from each other.

11. An apparatus as in claim 8, wherein the second member in the developer unit includes a second auger, adapted to convey toner in a substantially opposite direction as the first-mentioned auger.

12. An apparatus as in claim 8, wherein the second member in the developer unit includes a roll adapted to convey at least a portion of the developer material to the photoconductive surface.

13. An apparatus as in claim 8, wherein the second member in the developer unit includes a donor roll adapted to convey at least a portion of the developer material to the photoconductive surface, and further comprising a magnetic roll for transporting at least a portion of the developer material onto the donor roll, the magnetic roll adapted to receive rotational drive from the source of rotational motion.

14. An apparatus as in claim 13, further comprising a second auger in the developer unit, adapted to receive rotational drive from the source of rotational motion, and to convey toner in a substantially opposite direction as the first-mentioned auger.

* * * * *